US009486680B2

(12) United States Patent
Burger et al.

(10) Patent No.: US 9,486,680 B2
(45) Date of Patent: Nov. 8, 2016

(54) VARIABLE STIFFNESS STRIKING IMPLEMENT

(71) Applicant: Wilson Sporting Goods Co., Chicago, IL (US)

(72) Inventors: George W. Burger, Rocklin, CA (US); James M. Earley, Roseville, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 14/957,957

(22) Filed: Dec. 3, 2015

(65) Prior Publication Data

US 2016/0158613 A1 Jun. 9, 2016

Related U.S. Application Data

(60) Provisional application No. 62/089,486, filed on Dec. 9, 2014.

(51) Int. Cl.
*A63B 59/50* (2015.01)

(52) U.S. Cl.
CPC ..... *A63B 59/50* (2015.10); *A63B 59/51* (2015.10); *A63B 59/54* (2015.10)

(58) Field of Classification Search
CPC ..... A63B 2102/18; A63B 2102/182; A63B 59/50–59/58; A63B 2059/581
USPC ..... 473/457, 519, 520, 564–568
See application file for complete search history.

(56) References Cited

U.S. PATENT DOCUMENTS 6,485,382 B1 * 11/2002 Chen ..... A63B 59/50 473/566
7,052,419 B2 * 5/2006 Chang ..... A63B 59/50 473/566
7,166,046 B1 * 1/2007 Liu ..... A63B 59/50 473/457
7,311,620 B1 * 12/2007 Heald ..... A63B 59/50 473/566
7,381,141 B2 * 6/2008 Van Nguyen ..... A63B 59/50 473/566
7,419,446 B2 * 9/2008 Nguyen ..... A63B 59/50 473/566
7,572,197 B2 * 8/2009 Chauvin ..... A63B 59/00 473/520
7,942,764 B2 * 5/2011 Chung ..... A63B 59/50 473/564
7,980,970 B2 * 7/2011 Watari ..... A63B 59/50 473/566
8,226,505 B2 * 7/2012 Burger ..... A63B 59/50 473/520
8,313,397 B2 * 11/2012 Watari ..... A63B 59/50 473/564
8,894,518 B2 * 11/2014 Chung ..... A63B 59/00 473/564
2006/0252586 A1 * 11/2006 Nguyen ..... A63B 59/50 473/564
2007/0142135 A1 * 6/2007 Cheng ..... A63B 59/50 473/564
2007/0191156 A1 * 8/2007 Van Nguyen ..... A63B 59/50 473/564

* cited by examiner

*Primary Examiner* — Mark Graham
(74) *Attorney, Agent, or Firm* — Terence P. O'Brien; James C. Eaves, Jr.; Bingham Greenebaum Doll LLP

(57) ABSTRACT

A variable stiffness striking implement, such as, for example, a ball bat typically used in baseball, softball, or rubber ball. The striking implement, preferably has a separate barrel and handle and includes a variable stiffness assembly which results in the user being able to adjust stiffness. This is accomplished by the user selecting a stiffness member having a desired hardness and inserting the selected stiffness around the handle and abutting the end of the barrel closest to the handle end and using a cap to hold the stiffness member in place, or, if desired by the user, the striking implement may be used without a stiffness member.

20 Claims, 5 Drawing Sheets

VARIABLE STIFFNESS STRIKING IMPLEMENT

This application claims the benefit of U.S. provisional patent application Ser. No. 62/089,486, filed Dec. 9, 2014, for VARIABLE STIFFNESS BAT, incorporated herein by reference.

BACKGROUND OF THE INVENTION

Field of the Invention

The present invention relates to a variable stiffness striking implement, such as, for example, a ball bat typically used for striking a ball in a game of baseball or softball or rubber ball.

SUMMARY OF THE INVENTION

The present invention relates to a variable stiffness striking implement, such as, for example, a ball bat typically used in baseball, softball, or rubber ball. However, the variable stiffness features taught herein have application in striking implements used for other than hitting a baseball, softball, or rubber ball; such as, for example, without limitation, use in cricket, tennis, or hockey. Hereinafter, for ease of reference but without limitation, the striking implement of the present invention will be referred to as a bat.

The bat, preferably having a separate barrel and handle includes a variable stiffness assembly which results in the user being able to adjust the stiffness of the bat. This is accomplished by the user selecting a stiffness member having a desired hardness and inserting the selected stiffness member around the handle and abutting the end of the barrel closest to the handle end of the bat and using a cap to hold the stiffness member in place, or, if desired by the user, the bat may be used without a stiffness member. Each of these configurations will provide a different stiffness, as explained herein. The barrel and handle may be made of any known material used in manufacturing bats and the barrel and handle may be made of the same or different materials. The bat end cap and knob are also of known construction and compatible with the materials selected for manufacture of the barrel and handle.

The present invention is for a striking implement, comprising: a barrel, the barrel having a barrel end cap end and a barrel handle end and a barrel interior surface, the barrel having an internal joint receiving portion toward the barrel handle end; a handle, the handle having a handle knob end and a handle barrel end; an interface portion, the interface portion having an interface portion barrel end and an interface portion handle end, the interface portion having a joint receptacle and an interface portion stiffness member receiving portion and an interface portion coupling portion, the interface portion coupling portion being located closer to the interface portion handle end than the joint receptacle and the interface portion stiffness member receiving portion being located between the joint receptacle and the interface portion coupling portion; the interface portion being received over the handle and secured thereto, the interface portion handle end being orientated toward the handle knob end; the interface portion joint receptacle receiving a joint therein, the interface portion receiving at least a portion of a wedge thereover, the wedge being located closer to the interface portion barrel end than the joint receptacle; the handle with the interface portion being received into the barrel with at least a portion of an exterior surface of the wedge engaging the barrel interior surface, the joint received in the interface portion joint receptacle also being received in the barrel internal joint receiving portion, the interface portion stiffness member receiving portion and the interface portion coupling portion extending external of the barrel from the barrel handle end; a cap having a cap barrel end and a cap knob end, the cap having a cap coupling portion; and, the cap being inserted over the handle with the cap barrel end oriented toward the barrel and the cap coupling portion engageable with the interface portion coupling portion.

In one implementation, the cap can engage the barrel handle end, while in another implementation, the cap cannot engage the barrel handle end.

The striking implement of this invention may also include a stiffness member received by the interface portion stiffness member receiving portion and where the cap is coupled onto the interface portion coupling portion such that the stiffness member is held between the barrel handle end and the cap barrel end. With two implementations, the stiffness member may have a uniform hardness or the stiffness member may have a harder durometer portion and a softer durometer portion. In this latter implementation, the harder durometer portion abuts the cap barrel end and the softer durometer portion abuts the barrel handle end. Also, the stiffness member may have a slit therethrough.

More specifically, the cap may have an inward notched portion at its barrel end and the stiffness member may have a notched portion insert received into the cap inward notched portion. Further, the barrel handle end may angle inward and the stiffness member may have a barrel engaging end which abuts the angled inward barrel handle end.

Further, the interface portion coupling portion and the cap coupling portion may have engageable threads thereon.

There are two implementations of the wedge of the instant invention. In one, the wedge may engage the interface portion and the barrel interior surface, but not engage the handle. In the other, the wedge engages the interface portion and the handle, and where the wedge engages the barrel interior surface, the wedge has a portion nearest the handle barrel end where the wedge engages the handle but not the barrel interior surface.

Even more specifically, the striking implement of the present invention may be a bat where the barrel has an end cap at its end cap end, the barrel has a uniform diameter portion toward its end cap end and a tapered portion toward the barrel handle end, where the exterior surface of the wedge engaging the barrel interior surface is in the tapered portion, and where the handle has a knob at the handle knob end.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
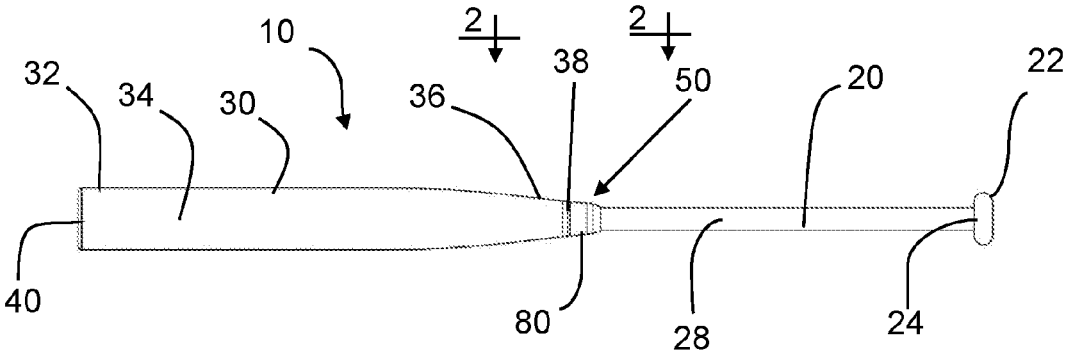
FIG. 1 is an external perspective view of one implementation of a variable stiffness ball bat of the present invention, typically used in playing softball.

For the purposes of promoting an understanding of the principles of the invention, reference will now be made to selected embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document herein is a reference to an embodiment of a family of inventions, with no single embodiment including features that are necessarily included in all embodiments, unless otherwise stated. Further, although there may be references to "advantages" provided by some embodiments of the present invention, it is understood that other embodiments may not include those same advantages, or may include different advantages. Any advantages described herein are not to be construed as limiting to any of the claims.

Specific quantities (spatial dimensions, angles, dimensionless parameters, etc.) may be used explicitly or implicitly herein, such specific quantities are presented as examples and are approximate values unless otherwise indicated. Discussions pertaining to specific compositions of matter are presented as examples and do not limit the applicability of other compositions of matter, especially other compositions of matter with similar properties, unless otherwise indicated.

Figure 2:
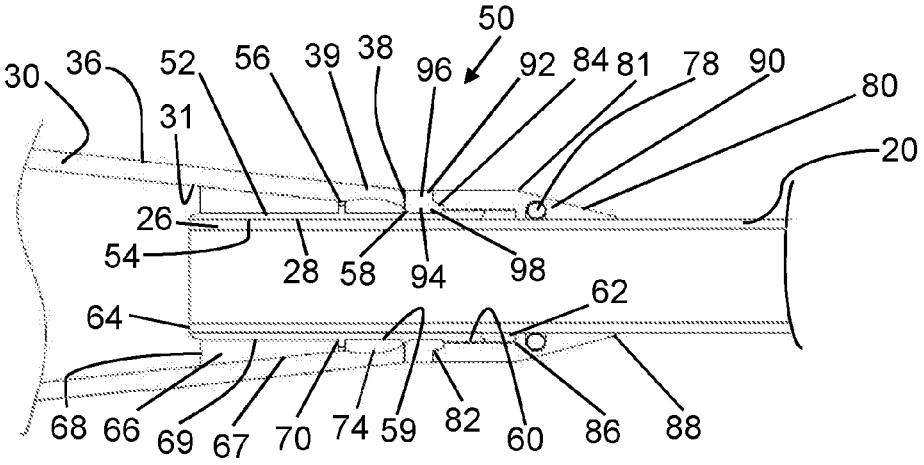
FIG. 2 is a cross-section view of a portion of the bat of FIG. 1 along the lines 2-2 shown in FIG. 1, the section view showing a stiffness member received between the end of the barrel and the cap.
Figure 3:
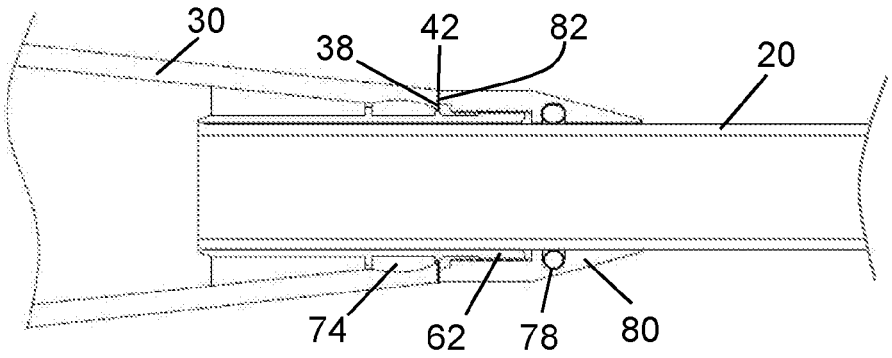
FIG. 3 is a similar cross-section view to that of FIG. 2, but without a stiffness member, where the end of the barrel engages the cap.
Figure 4:
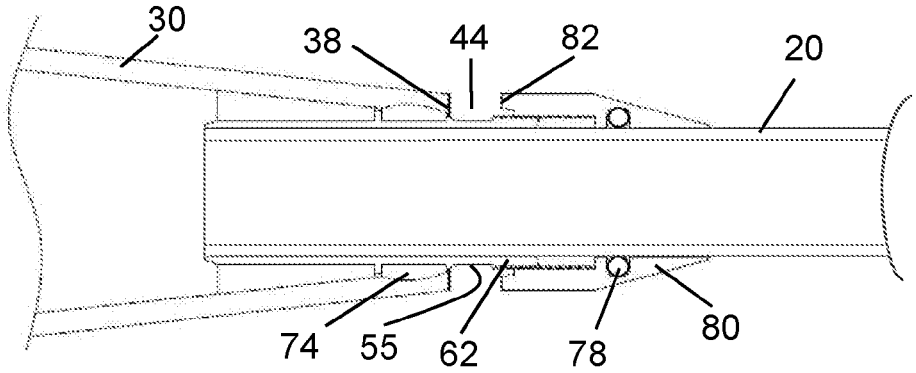
FIG. 4 is a similar cross-section view to that of FIGS. 2 and 3, without a stiffness member, where the end of the barrel does not engage the cap.
Figure 5:
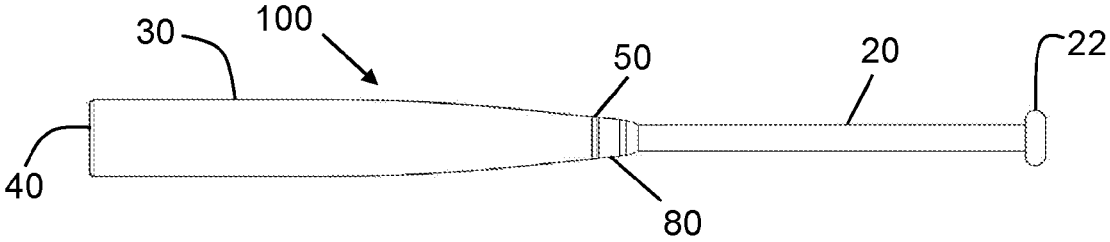
FIG. 5 is a perspective view of another implementation of a variable stiffness ball bat of the present invention, typically used in playing baseball.

It is noted that two embodiments of a bat where the stiffness is variable are shown in the figures, the first embodiment being shown specifically in FIGS. 2-4 and the second embodiment being shown specifically in FIGS. 6-10. Either of these two embodiments may be included in a softball bat such as shown in FIG. 1, a baseball bat such as shown in FIG. 5, a rubber ball bat, or other striking implement.

With reference now to FIGS. 1-5, the following cross-reference relates the identified items and their corresponding numbers. Variable stiffness ball bat 10, 100; handle 20; knob 22; handle knob end 24; handle barrel end 26; handle distal portion 28 having a uniform outside diameter; barrel 30; barrel interior surface 31; barrel end cap end 32; barrel portion 34 having a generally uniform outer diameter; barrel tapered portion 36; barrel handle end 38; barrel joint receiving portion 39; end cap 40; location 42; gap 44; variable stiffness assembly 50; interface portion 52; interface portion uniform inside diameter portion 54; interface portion stiffness member receiving portion 55; interface portion first stop 56; interface portion second stop 58; interface portion joint receptacle 59; interface portion coupling portion 60; interface portion handle end 62; interface portion barrel end 64; wedge 66; wedge exterior surface 67; wedge end cap end 68; wedge interior surface 69; wedge knob end 70; joint 74; o-ring 78; cap 80; cap exterior surface 81; cap barrel end 82; cap notched portion 84; cap coupling portion 86; cap knob end 88; cap o-ring channel 90; stiffness member 92; stiffness member larger thickness interior portion 94; stiffness member small thickness exterior portion 96; and stiffness member notch portion insert 98.

With reference now to FIGS. 6-10, the following cross-reference relates the identified items and their corresponding numbers. Handle 20; handle barrel end 26; barrel 130; barrel interior surface 131; barrel tapered portion 136; barrel handle end 138; barrel joint receiving portion 139; gap 144; variable stiffness assembly 150; interface portion 152; interface portion uniform inside diameter portion 154; interface portion stiffness member receiving portion 155; interface portion first stop 156; interface portion second stop 158; interface portion joint receptacle 159; interface portion coupling portion 160; interface portion handle end 162; interface portion barrel end 164; wedge 166; wedge exterior surface 167; wedge end cap end 168; wedge interior surface 169; wedge knob end 170; wedge portion abutting interface portion on the wedge interior surface and barrel on the wedge exterior surface 171; wedge portion abutting handle on wedge interior surface and barrel on wedge exterior surface 172; wedge portion abutting handle on wedge interior surface but not abutting barrel 173; joint 74; o-ring 78; cap 180; cap exterior surface with raised ribs 181; cap barrel end 182; cap notched portion 184; cap coupling portion 186; cap knob end 188; cap o-ring channel 190; decorative band 191; stiffness member 192; harder durometer portion 193;

stiffness member larger thickness interior portion 194; softer durometer portion 195; stiffness member small thickness exterior portion 196; slit 197; stiffness member notch portion insert 198; notch 199; and barrel engaging end 200.

Figure 11:
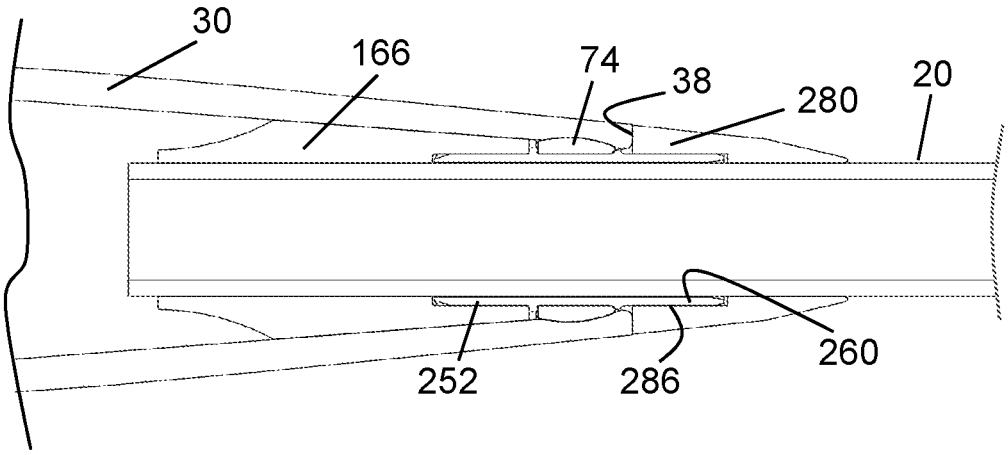

With reference to FIG. 11, following cross-reference relates the identified items and their corresponding numbers. Handle 20; barrel 30; barrel end 38; joint 74; interface portion 252; interface portion coupling portion 260; cap 280; and cap coupling portion 286.

With reference to FIGS. 1 and 2, a variable stiffness ball bat 10 is shown in full in FIG. 1 and a portion of the bat is shown in cross-section in FIG. 2 along the lines 2-2 shown in FIG. 1. This bat 10 is designed for use in playing softball. FIG. 5 shows a similar bat 100, but bat 100 is designed for use in playing baseball. In general, it is typical that the barrel of a baseball bat, such as bat 100, has a shorter length uniform diameter portion and a longer tapered portion in comparison to that of a softball bat, such as bat 10. Bats 10 and 100 represent conventional softball and baseball bat shapes and other shapes of softball and baseball bats can be used with the variable stiffness assembly 50 of the instant invention. For example, this invention could be employed with rubber ball bats typically used in Japan, those bats having barrels similar to baseball bats, or with other similar striking implements. Both bats 10 and 100 have a handle 20 with a conventional knob 22 attached thereto and a barrel 30 having a conventional end cap 40. Handle 20 and barrel 30 are preferably separate pieces, where a portion of handle 20 is received within barrel 30 at the variable stiffness interface portion 50.

With further reference to FIGS. 1 and 2, bat 10 is seen having handle 20 having a knob end 24, which receives knob 22 thereon, a barrel end 26, and a distal portion 28 having a generally uniform outside diameter. In one implementation, the entire handle 20 can have a uniform outside diameter. In another implementation, the outside diameter of the handle can be varied along its length. Barrel 30 has an end cap end 32, which receives an end cap 40, a generally uniform diameter portion 34, a tapered portion 36, a handle end 38, and a joint receiving portion 39. Joint receiving portion 39 is a recessed area on the interior of the barrel 30 toward the handle end 38 and is formed during manufacture of the barrel 30. The joint receiving portion 39 is shown having one particular shape. In other implementations, the joint receiving portion 39 can be formed in other curved shapes.

Variable stiffness assembly 50 comprises an interface portion 52, a wedge 66, a joint 74, an o-ring 78, a cap 80, and may or may not include a stiffness member 92.

Interface portion 52 is preferably made of aluminum and is generally of cylindrical shape. In other implementations, the interface portion 52 can be formed of other materials, such as, for example, a fiber composite material, a polymeric material, titanium, other metals, or combinations thereof. It has a uniform inside diameter portion 54 which is sized so that the distal portion 28 of handle 20 can be received therein, and preferably adhesively affixed therein toward the barrel end 26 of handle 20. While the outer surface of interface portion 52 is generally cylindrical, from its barrel end 64 toward its handle end 62, there is a first stop 56 and a second stop 58, these first stop 56 and second stop 58 creating a joint receptacle 59 therebetween. From the handle end 62 of the interface portion 50 for a distance along the outer surface thereof toward the barrel end 64 is a coupling portion 60. Between second stop 58 and coupling portion 60 is an interface portion stiffness member receiving portion 55. From the barrel end 64 toward the first stop 56, the preferably aluminum outer surface of interface portion 52 is preferable grit blasted for better adhesion with the interior surface 69 of a wedge 66. In other implementations, other surface treatments or no surface treatment can be used.

Wedge 66 has the shape of a truncated conical section or frustum with a center cylindrical opening therethrough. Wedge 66 has an end cap end 68, a knob end 70, an interior surface 69 and an exterior surface 67. Wedge 66 is preferably made of EPDM rubber with a preferable hardness of about 45 Shore A. In other implementations, the wedge can be formed of other rubbers, other elastomeric materials, or combinations thereof.

Cap 80, preferably made of aluminum, has an exterior surface 81 which is, for example without limitation, gnarled or fluted to assist one in rotating the cap 80. In other implementations, the cap 80 can be formed of other materials, such as, for example, a fiber composite material, a polymeric material, a plastic, titanium, other metals, or combinations thereof.

Cap 80 has a barrel end 82 with a notched portion 84 at the barrel end. From the notched portion 84, along the inside surface of the cap 80 toward the knob end 88, is a coupling portion 86. As is shown in FIGS. 2-4, coupling portion 86 of cap 80 and coupling portion 60 of interface portion 52 are threaded. As such, cap 80 can be coupled to interface portion 52 at respective coupling portions 86 and 60 by threading cap 80 onto the threads of coupling portion 60. Preferably, these coupling portions 86 and 60 have threads with 32 teeth per inch (2.54 cm). In other implementations, other teeth per inch thread counts can be used. Between the coupling portion 86 and knob end 88 is an o-ring channel 90 which receives an o-ring 78 therein. O-ring 78 will exert friction between the handle 20 and the cap 80 so that the cap 80 will not rotate without an outside force being exerted thereon. In another implementation, the cap and interface portion can include coupling mechanisms other than a threaded connection, such as, for example, a press-fit connection, a slotted quarter-turn connection, a ball and groove connection, a tongue and groove connection, resilient tabs and/or notches, and combinations thereof. Even further, cap 80 and interface portion 52 can be permanently coupled by, for example, adhesively affixing them together.

A stiffness member 92 is shown having a larger thickness interior portion 94, a smaller thickness exterior portion 96, and a notch insert portion 98. Stiffness members can be made of various hardness and size. For example, without limitation, stiffness members 92 can have a hardness of from 30 Shore A to 50 Shore D. As an example, a user could elect to use a stiffness member 92 with a hardness of 30 Shore A, or a different member with a hardness of 60 Shore A, or a different member with a hardness of 90 Shore A. Similarly, the shape of the stiffness member can also be varied. The use, or non-use, of one of these stiffness members 92 will be explained hereinafter.

To assemble the bat 10 or 100, as seen in FIG. 1 or 5, for the first embodiment of FIGS. 2-4, the barrel 30, having the joint receiving portion 39 on its inside surface near handle end 38, and a separate handle 20 are manufactured, both preferably made of a graphite material, although other known materials may be used and the barrel and handle may be of same or different materials. The end cap 40 and the knob 22 will be attached later.

First, interface portion 52, with its coupling portion 60 oriented toward the handle knob end 24, is inserted over and glued on to handle 20 toward the handle barrel end 26. The glue is allowed to cure so that interface portion 52 is securely attached to handle 20. Next, the joint 74, preferably made of a nylon material, is snapped into position over the interface portion 52 between the first stop 56 and second stop 58. In other implementations, for example, the joint can be formed of a plastic, a metal, a fiber composite material, or combinations thereof. Next, the wedge 66 is glued onto interface portion 52, such that the wedge knob end 70 abuts first stop 56, and the glue is allowed to cure.

This handle 20, with interface portion 52, with joint 74, and wedge 66 is ready for insertion into the barrel 30. Wedge 66 has glue placed on its exterior surface 67. The handle 20 is now inserted into the barrel end cap end 32 of barrel 30, the handle 20 having its handle knob end 24 inserted first. The handle barrel end 26 has force applied to it until the joint 74 is received into barrel joint receiving portion 39, which also means that the wedge exterior surface 67 with glue thereon engages the barrel interior 31. In this configuration, the interface portion stiffness member receiving portion 55 and interface portion coupling portion 60 extend externally of the barrel 30 beyond barrel handle end 38. In another implementation, the wedge may be installed without an adhesive on one or both of the interior surface 69 and the exterior surface 67.

With the handle 20 and barrel 30 connected by joint 74 and wedge 66, cap 80, with o-ring 78 inserted into o-ring channel 90, is inserted over handle knob end 24, cap 80 having its barrel end 82 oriented toward the barrel handle end 38. Cap 80 is moved toward handle barrel end 26 so that coupling portion 86 of cap 80 can engage interface portion coupling portion 60. A conventional end cap 40 and knob 22, known in the art, can now be affixed to barrel 30 and handle 22, respectively.

The bats of the present invention can be used with a selected stiffness member 92 having a desired hardness or no stiffness member can be used. With specific reference to the first embodiment of FIGS. 2, 3, and 4, FIG. 4 shows the bat with the cap 80 threaded partly on to the interface portion 52, where no stiffness member 92 is employed, so that there is a gap 44 between the barrel end 82 of cap 80 and handle end 38 of barrel 30. For the configurations shown in FIGS. 2, 3, and 4, this configuration of FIG. 4 results in a bat with the least stiffness. When looking at the bat of FIG. 3, at location 42, it is seen that cap 80 has been threaded onto interface portion 52 so that barrel end 82 of cap 80 and handle end 38 of barrel 30 are touching. This configuration of FIG. 3 results in a bat with the most stiffness. In contrast, with the bat of FIG. 2, a stiffness member 92 of desired hardness has been selected and inserted onto interface portion stiffness member receiving portion 55 so that it's larger thickness interior portion 94 engages the interface portion 52 so that notched portion 98 can be received by notched portion 84 of cap 80. With the cap 80 threaded onto the interface portion 52 as shown, stiffness member 92 will provide a bat with a stiffness between that of the bat of FIG. 4 and the bat of FIG. 3.

With this first embodiment of FIGS. 2-4, as well as with the second embodiment of FIGS. 6-10 explained below, various options are possible for the bat user. The user could obtain a bat having, for example, a set of three stiffness members. These stiffness members could be of any hardness, but, for example, we will say the stiffness members have hardnesses of 30 Shore A, 60 Shore A, and 90 Shore A. The user can then try the bat with the different hardness stiffness members and select one hardness to use all of the time or change as the user desires. If a replacement stiffness member is needed, the user can obtain just the desired hardness stiffness member or another set. Alternatively, the user could try out or test a bat, for example at a batting cage or sporting goods store, and then obtain a bat having just the desired hardness stiffness member. As such, each bat is customizable to the specific user with the stiffness member being replaceable. It is noted that, if a user only desires a specific hardness, the bat of the instant invention can be provided with the desired stiffness member with the cap permanently coupled to the interface portion. Even further, in this configuration, as an option, the stiffness member and the cap can be combined into a single piece. Where the cap is to be permanently coupled to the interface portion, o-ring channel 90 in cap 80 and o-ring 78 could be eliminated. An example of this implementation is demonstrated in FIG. 11. FIG. 11 includes handle 20, barrel 30 with barrel end 38, joint 74, interface portion 252 with interface portion coupling portion 260 but with no stiffness member receiving portion, and cap 280 with cap coupling portion 286. In this implementation, the stiffness member is integrated into cap 280, as cap 280 can be made of any desired hardness, for example, from 30 Shore A to 50 Shore D. One user may elect a bat with a cap having a hardness of 90 Shore A, while another user may elect a bat with a cap having a hardness of 60 Shore A. This implementation of FIG. 11 is shown without an o-ring channel or an o-ring and the cap is permanently coupled.

With reference to FIGS. 6-10, a second embodiment is shown and the differences between this second embodiment and the first embodiment of FIGS. 2-4 will be explained. If not mentioned with this description of FIGS. 6-10, the elements and assembly are the same as described above for the first embodiment of FIGS. 2-4.

Figure 6:
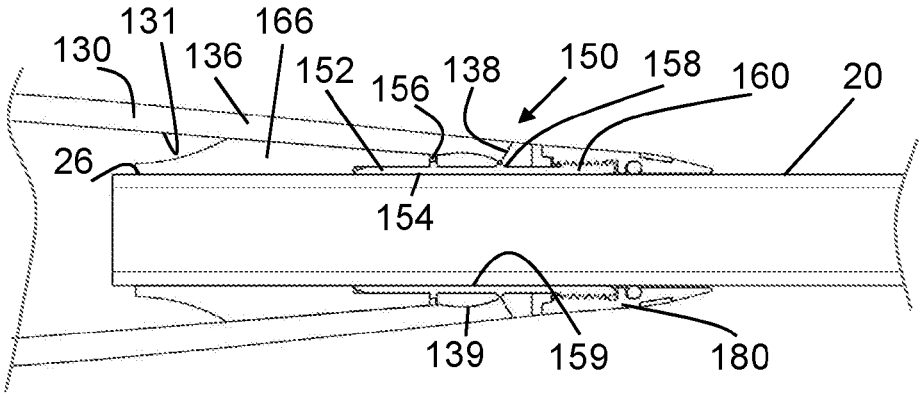
FIG. 6 is a cross-section view of a portion of the bat of FIG. 1 along the lines 2-2 shown in FIG. 1, the section view showing a stiffness member received between the end of the barrel and the cap, the interior of this bat having a different internal structure than that shown in FIGS. 2-4.
Figure 7:
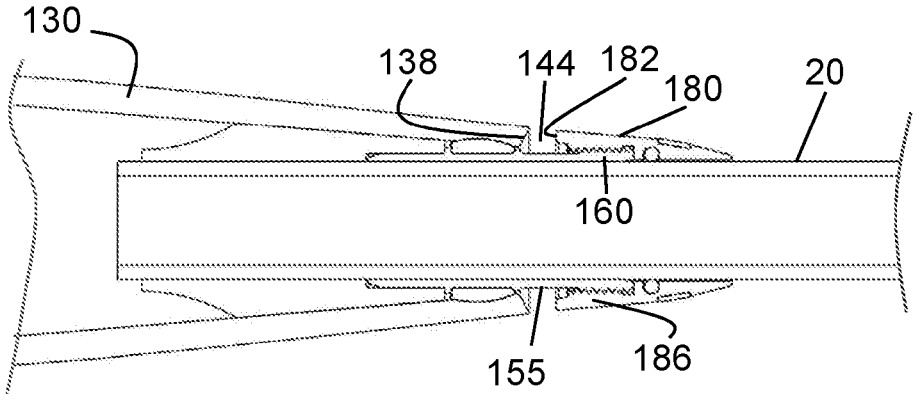
FIG. 7 is a similar cross-section view to that of FIG. 6, but without a stiffness member, where the end of the barrel cannot engage the cap.
Figure 8:
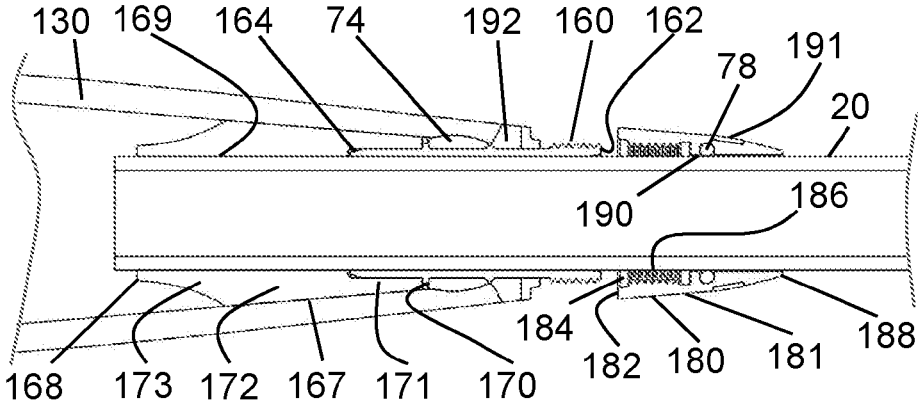
FIG. 8 is a similar cross-section view to that of FIGS. 6 and 7, without a stiffness member, where the cap is shown at its uncoupled location.
Figure 9:
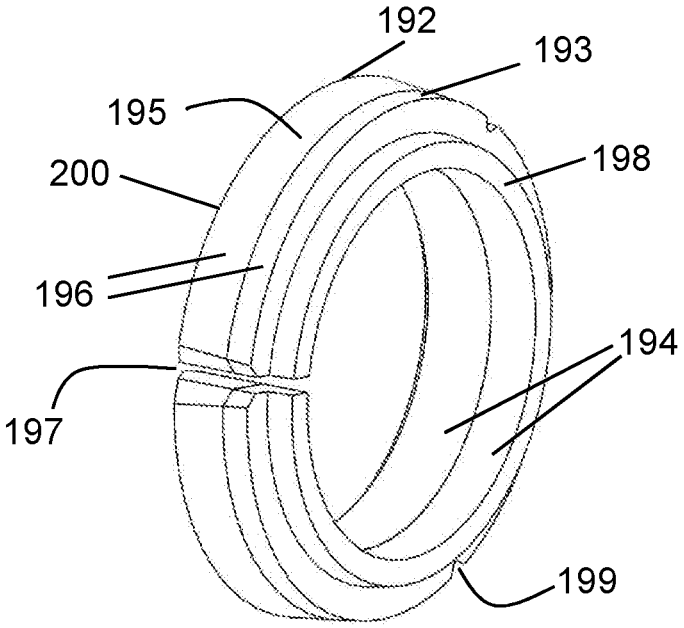
FIG. 9 is a perspective view of stiffness member used with a bat having the internal bat structure shown in FIGS. 6-8.
Figure 10:
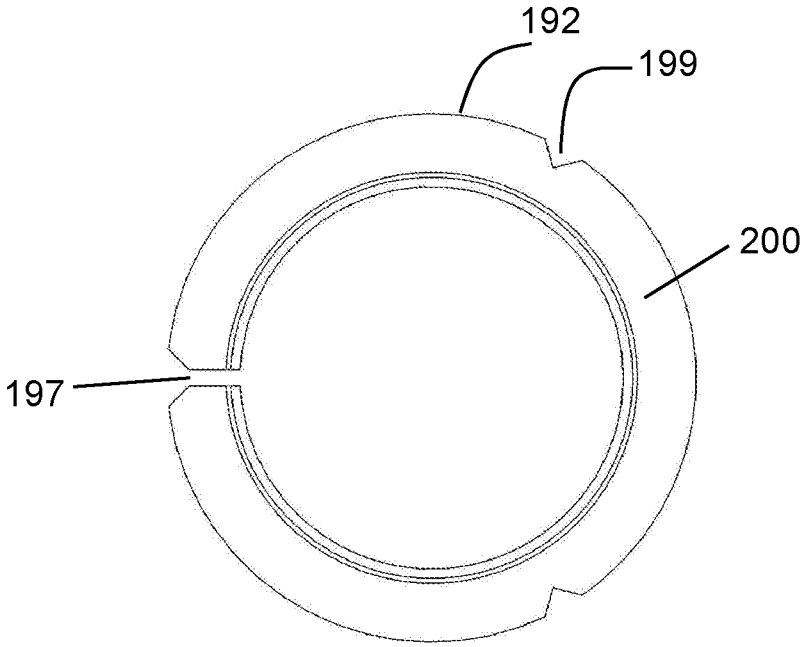
FIG. 10 is an end view of stiffness member of FIG. 9 looking toward at its barrel engaging end; and, FIG. 11 is a cross-section view of a portion of a bat showing a cap which provides a stiffness member function.

With the possible exception of a longer length from handle barrel end 26 to handle knob end 24 (FIG. 1), handle 20 with handle barrel end 26 shown in FIGS. 6-8 is the same handle 20 as appears in FIGS. 2-4. However, barrel 130, with barrel interior surface 131, barrel tapered portion 136, barrel handle end 138, and barrel joint receiving portion 139, shown in FIGS. 6-8 differs from barrel 30 shown in FIGS. 2-4 in that the barrel handle end 138 differs from barrel handle end 38. In FIGS. 2-4, barrel handle end 38 is generally transverse to or perpendicular to handle 20. In contrast, in FIGS. 6-8, barrel handle end 138 angles inward such that the barrel 130 side of gap 144 is wider at the variable stiffness assembly 150 than at the exterior of barrel 130. As is explained later, this inward angling helps to retain a selected stiffness member 192 in proper position. This inward angling is shown best in FIG. 7. Without limitation, an inward angle of between 5° and 45° from transverse helps retention without compromising the durability of the barrel handle end 138.

With continued reference to FIGS. 6-8, variable stiffness assembly 150, with interface portion 152, interface portion uniform inside diameter portion 154, interface portion stiffness member receiving portion 155, interface portion first stop 156, interface portion second stop 158, interface portion joint receptacle 159, interface portion coupling portion 160; interface portion handle end 162, and interface portion barrel end 164, differs from variable stiffness assembly 150 of FIGS. 2-4. The length of the portion of interface portion 152 between the interface portion barrel end 164 and the first stop 156 (FIGS. 6-8) is less than that for the length between end 64 and first stop 56 (FIGS. 2-4).

Also, wedge 166, with wedge exterior surface 167, wedge end cap end 168, wedge interior surface 169, and wedge knob end 170 of FIGS. 6-8 differs from wedge 66 of FIGS. 2-4. This changed shape of wedge 166 in FIGS. 6-8 requires that interface portion 152, with its coupling portion 160 oriented toward the handle knob end 24, being inserted over and glued on to handle 20 toward the handle barrel end 26, is positioned further from the handle barrel end 26 than for interface portion 52 of FIGS. 2-4. As such, handle barrel end 26 of FIGS. 6-8 is received further into barrel 130 than handle barrel end 26 of FIGS. 2-4 is received into barrel 30. Hence the comment above that the handle 20 used in the embodiment of FIGS. 6-8 may be longer than the handle 20 used with the embodiment of FIGS. 2-4 so as to form bats having the same length. As is seen in FIGS. 6-8, from closest to barrel handle end 138 to furthest therefrom, wedge 166 first has a wedge portion abutting interface portion on the wedge interior surface and barrel on the wedge exterior surface 171, then a wedge portion abutting handle on wedge interior surface and barrel on wedge exterior surface 172, and then a wedge portion abutting handle on wedge interior surface but not abutting barrel 173. In assembly, wedge 166 preferably has glue on its interior surface 169 and is glued to the interface portion 152 and handle 20 along wedge portions 171, 172, and 173. When inserted into barrel 130, wedge exterior surface 167 preferably has glue placed thereon at wedge portions 171 and 172 and those portions engage barrel interior surface 131. Wedge portion 173 does not engage the barrel interior surface 131. This wedge 166 and this second embodiment of FIGS. 6-10 are believed by the inventors to be the best mode, as this construction provides wedge 166 with additional surface area to engage interface portion 152 and handle 20 while still allowing the wedge 166 to provide a dampening effect. Even further, the inventors believe that this construction provides wedge 166 with additional thickness between wedge interior surface 169 and wedge exterior surface 167 allowing for an enhanced dampening effect. Also, by having the extended wedge portion 173 which does not contact the barrel interior surface 131, as the bat is used, the interface of the wedge 166 with the barrel interior surface 131 at the intersection of wedge portions 172 and 173 can provide better durability in use. As with wedge 66, wedge 166 is preferably made of EPDM rubber with a preferable hardness of about 45 Shore A, although different materials and hardness can be used in other implementations.

The joint 74 and o-ring 78 are the same in both the embodiments of FIGS. 2-4 and 6-8.

The cap 180, with cap exterior surface with raised ribs 181, cap barrel end 182, cap notched portion 184, cap coupling portion 186, cap knob end 188, cap o-ring channel 190, and decorative band 191, in FIGS. 6-8 differs from cap 80 of FIGS. 2-4. Plus the engagement of cap coupling portion 186 and interface portion coupling portion 160, shown as a threaded coupling, differ from the engagement of coupling portions 86 and 60 of the first embodiment. In FIG. 3, coupling portions 86 and 60 permit cap 80 to be coupled so that barrel end 82 of cap 80 can engage barrel handle end 38. In contrast, with reference to FIG. 7, cap 180 is threaded as far as the threaded portions permit, leaving gap 144 between barrel end 182 of cap 180 and barrel handle end 138. The inventors also believe that this construction of the second embodiment is better than that of the first embodiment, in that, with barrels made of some materials, with extended use, barrel end 38 can wear with end 38 being in contact with barrel end 82 of cap 80.

With reference now to FIGS. 6-10, stiffness member 192 differs from stiffness member 92 of the first embodiment, both in shape and construction. As to the first embodiment, stiffness member 92 was preferably of a single durometer as selected by the user. In one implementation, the user can be provided with a set of two or more stiffness members of varying hardnesses, and the user can select one of the set of stiffness members for use. This stiffness member 92 was inserted into stiffness member receiving portion 55 and cap 80 coupled so that stiffness member 92 was held in place by the notch portion insert 98 being received into notched portion 84 of cap 80 along with cap 80 holding the stiffness member 92 against barrel handle end 38. With this second embodiment of FIGS. 6-10, stiffness member 192 includes a harder durometer portion 193, stiffness member larger thickness interior portion 194, softer durometer portion 195, stiffness member small thickness exterior portion 196, slit 197, stiffness member notch portion insert 198, notch 199, and barrel engaging end 200. Hence, stiffness member 192 is of dual durometer construction, unless the user selects a member 192 where the portions 193 and 193 are of the same hardness. Most preferably, without limitation, harder durometer portion 193 has a hardness of 90 Shore A, and softer durometer portion 195 can have a hardness, for example, of 30, or 60, or 90 Shore A. Clearly, other hardnesses, or combinations of hardnesses, for both portions 193 and 195 can be selected. In the first embodiment, stiffness member 92 was shown without a slit, thereby being stretched over the outside of the bat for insertion into portion 55. With this stiffness member 192 of the second embodiment having the harder durometer portion 193, stiffness member 192 preferably includes slit 197 therethrough. With slit 197 and notches 199, rather than stretching stiffness member 192 for insertion into portion 155, the stiffness member 192 can be spread apart and inserted into portion 155. It is noted that, if desired, member 92 of the first embodiment could also include a slit with or without notches, which could be desirable with member 92 of a harder durometer. With reference to FIGS. 6-10, and as seen in FIG. 6, stiffness member 192 has been inserted into stiffness member receiving portion 155 and cap 180 threadably tightened so that stiffness member 192 is held in place by the notch portion insert 198 being received into notched portion 184 of cap 180 along with cap 180 holding the stiffness member 92 against barrel handle end 138 with end 138's inward angle providing additional mechanical locking of stiffness member 192 within gap 144.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A striking implement, comprising:

a barrel, the barrel having a barrel end cap end and a barrel handle end and a barrel interior surface, the barrel having an internal joint receiving portion toward the barrel handle end;

a handle, the handle having a handle knob end and a handle barrel end;

an interface portion, the interface portion having an interface portion barrel end and an interface portion handle end, the interface portion having a joint receptacle and an interface portion stiffness member receiving portion and an interface portion coupling portion, the interface portion coupling portion being located closer to the interface portion handle end than the joint receptacle and the interface portion stiffness member receiving portion being located between the joint receptacle and the interface portion coupling portion;

the interface portion being received over the handle and secured thereto, the interface portion handle end being orientated toward the handle knob end;

the interface portion joint receptacle receiving a joint therein, the interface portion receiving at least a portion of a wedge thereover, the wedge being located closer to the interface portion barrel end than the joint receptacle;

the handle with the interface portion being received into the barrel with at least a portion of an exterior surface of the wedge engaging the barrel interior surface, the joint received in the interface portion joint receptacle also being received in the barrel internal joint receiving portion, the interface portion stiffness member receiving portion and the interface portion coupling portion extending external of the barrel from the barrel handle end;

a cap having a cap barrel end and a cap knob end, the cap having a cap coupling portion; and, the cap being inserted over the handle with the cap barrel end oriented toward the barrel and the cap coupling portion engageable with the interface portion coupling portion.

2. The striking implement of claim 1, where the cap can engage the barrel handle end.

3. The striking implement of claim 1, where the cap cannot engage the barrel handle end.

4. The striking implement of claim 1, further comprising a stiffness member, the stiffness member being received by the interface portion stiffness member receiving portion and where the cap is coupled onto the interface portion coupling portion such that the stiffness member is held between the barrel handle end and the cap barrel end.

5. The striking implement of claim 4, where the stiffness member has a uniform hardness.

6. The striking implement of claim 4, where the stiffness member has a harder durometer portion and a softer durometer portion.

7. The striking implement of claim 6, where the harder durometer portion abuts the cap barrel end and where the softer durometer portion abuts the barrel handle end.

8. The striking implement of claim 4, where the cap has an inward notched portion at its barrel end and where the stiffness member has a notched portion insert received into the cap inward notched portion.

9. The striking implement of claim 4, where the barrel handle end angles inward and where the stiffness member has a barrel engaging end which abuts the angled inward barrel handle end.

10. The striking implement of claim 4, where the stiffness member has a slit therethrough.

11. The striking implement of claim 1, where the interface portion coupling portion and the cap coupling portion have engageable threads thereon.

12. The striking implement of claim 1, where the wedge engages the interface portion and the barrel interior surface, but does not engage the handle.

13. The striking implement of claim 1, where the wedge engages the interface portion and the handle, and where the wedge engages the barrel interior surface, the wedge having a portion nearest the handle barrel end where the wedge engages the handle but not the barrel interior surface.

14. The striking implement of claim 4, where the wedge engages the interface portion and the barrel interior surface, but does not engage the handle.

15. The striking implement of claim 4, where the wedge engages the interface portion and the handle, and where the wedge engages the barrel interior surface, the wedge having a portion nearest the handle barrel end where the wedge engages the handle but not the barrel interior surface.

16. The striking implement of claim 15, where the stiffness member has a harder durometer portion and a softer durometer portion.

17. The striking implement of claim 16, where the harder durometer portion abuts the cap barrel end and where the softer durometer portion abuts the barrel handle end.

18. The striking implement of claim 17, where the cap has an inward notched portion at its barrel end and where the stiffness member has a notched portion insert received into the cap inward notched portion.

19. The striking implement of claim 18, where the barrel handle end angles inward and where the stiffness member has a barrel engaging end which abuts the angled inward barrel handle end.

20. The striking implement of claim 1, where the striking implement is a bat, the barrel having an end cap at its end cap end, the barrel having a uniform diameter portion toward its end cap end and a tapered portion toward the barrel handle end, where the exterior surface of the wedge engaging the barrel interior surface is in the tapered portion, and where the handle has a knob at the handle knob end.

* * * * *